United States Patent [19]

Huaser

[11] 4,151,795

[45] May 1, 1979

[54] APPARATUS FOR SEPARATING LIQUIDS AND SOLIDS

[75] Inventor: Hans U. Huaser, Niederweningen, Switzerland

[73] Assignee: Bucher-Guyer AG Maschinenfabrik, Neiderweningen, Switzerland

[21] Appl. No.: 783,265

[22] Filed: Mar. 31, 1977

[30] Foreign Application Priority Data

Apr. 21, 1976 [CH] Switzerland ..... 4962/76

[51] Int. Cl.[2] ..... B30B 9/22

[52] U.S. Cl. ..... 100/117; 100/211

[58] Field of Search ..... 100/117, 211, 104, 110, 100/112, 116, 121, 127, 126

[56] References Cited

U.S. PATENT DOCUMENTS

| | | | |
|---|---|---|---|
| 594,297 | 11/1897 | Strattner | 100/107 |
| 2,824,438 | 2/1958 | Candor | 100/211 X |
| 3,052,113 | 9/1962 | Zimarik | 100/211 X |
| 3,478,909 | 11/1969 | Charles | 100/211 X |
| 3,550,526 | 12/1970 | Hoover | 100/117 X |
| 3,943,033 | 3/1976 | Wallen | 100/117 X |
| 4,024,810 | 5/1977 | Braun | 100/116 |

FOREIGN PATENT DOCUMENTS 1049205 12/1953 France.

*Primary Examiner*—Harvey C. Hornsby
*Assistant Examiner*—John M. Jillions
*Attorney, Agent, or Firm*—Werner W. Kleeman

[57] ABSTRACT

An apparatus for separating liquid and solid materials from one another, especially for the extraction of juice from agricultural products, particularly from fruit, comprising a press container rotatably mounted about a substantially horizontal axis. The press container is subdivided by means of a substantially hood-shaped press or squeezing diaphragm into a pressue compartment, which can be impinged by a pressurized fluid medium, and a press or squeezing compartment possessing a juice outlet arrangement. The press container possesses a tapered configuration and the juice outlet arrangement is disposed at a widened region of the press container.

22 Claims, 7 Drawing Figures

APPARATUS FOR SEPARATING LIQUIDS AND SOLIDS

BACKGROUND OF THE INVENTION

The present invention relates to a new and improved construction of apparatus for separating liquid and solid materials from one another, especially for the removal or extraction of juice from agricultural products, in particular from fruit, which apparatus is of the type comprising a press container mounted to be rotatable about a horizontal axis.

A typical construction of such type apparatus has been illustrated and disclosed in German patent publication No. 2,459,097. With this state-of-the-art equipment there is provided a piston-cylinder unit wherein the mash is exposed to a mechanical action which can influence the quality of the liquid which is pressed-out therefrom. This is especially also the case with worm or screw presses. The comminuting action also can cause release of undesired substances from the residues. But even in the case of mechanical presses of a different construction what has been stated above is also valid.

Apart from juice extracting equipment employing a press container (the last expression is used in its broadest sense), there have also become known to the art those using a drainage or drip container. While with such containers, even if they are rotatably mounted, there do not arise any deleterious mechanical effects, nonetheless what occurs with such equipment is simply a pre-dejuicing in that the juice predominantly flows-off under the action of the forces of gravity, and thus, the mash only partially has the juice extracted therefrom, for instance up to about 50 percent. Hence, it is necessary to thereafter resort to the use of presses, inherently resulting in having to accept all of their drawbacks.

SUMMARY OF THE INVENTION

Therefore, with the foregoing in mind it is a primary object of the present invention to provide an improved apparatus for separating liquid and solids from one another in a manner not associated with the aforementioned drawbacks and limitations of the prior art proposals.

Another and more specific object of the present invention aims at the provision of an apparatus of the previously mentioned type which combines the advantages of a drip container or colander with those of a press, and thus is capable of accomplishing a complete extraction and a complete emptying of the press container without the presence of deleterious or damaging mechanical effects.

Now in order to implement these and still further objects of the invention, which will become more readily apparent as the description proceeds, the apparatus for the separation of liquids and solids from one another as contemplated by the invention, is manifested by the features that the press container is subdivided by a substantially hood-shaped press or squeezing diaphragm into a pressure compartment which can be impinged by a pressurized fluid medium and a press or squeezing compartment equipped with a juice outlet arrangement. The press container possesses a tapered configuration or shape, and the juice outlet opening is arranged at a widened region of the press container.

With such construction of equipment the juice can already drip-off or drain during the filling of the press container, that is to say, during a relatively long time span in consideration of the usually considerable container volume employed for economical reasons. The intensity of the juice yield can be further increased by repeatedly rotating the press container, for instance, during the phase of operation where the pressure is relieved. During the actual pressing or squeezing operation the mash is then placed under pressure due to the action of the pressurized fluid medium, i.e. by means of a pressure cushion, which builds-up in the pressure compartment and acts upon the mash through the agency of the press or squeezing diaphragm. During this time the mash is not exposed to any damaging or undesirable mechanical loads, firstly because the pressure cushion surrounds the mash in a dome-like manner, and thus, exerts upon the mash a so-to-speak "soft" compression from a number of directions. Additionally, there is realized the beneficial result that the residues rapidly and completely can be removed in the direction of the tapered side of the press container, and at the same time the outflow of juice occurs at the other side of the container and therefore need not be interrupted even during the ejection or removal of the residues. In this way it is possible to accomplish a protective and relatively complete yield of juice from the agricultural products undergoing processing, during short work cycles which follow one another rapidly in succession.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
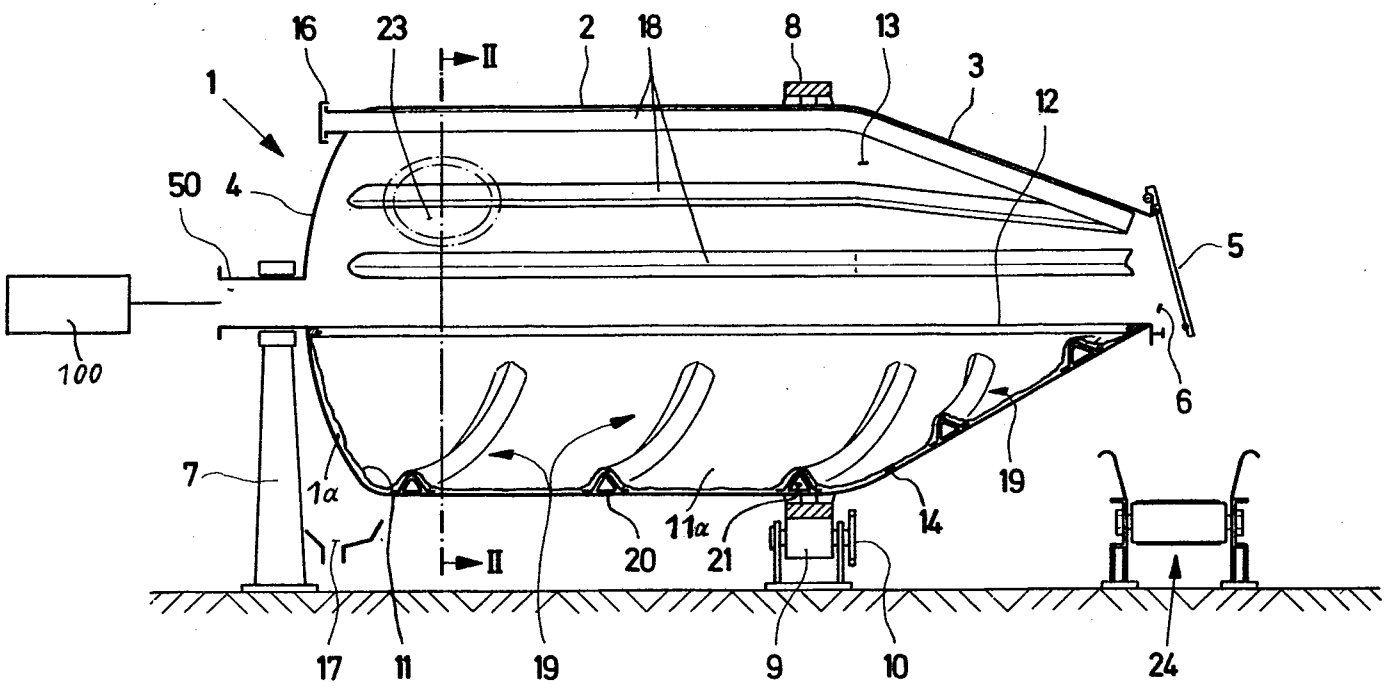
FIG. 1 is an axial sectional view illustrating a first exemplary embodiment of apparatus for extracting juice employing a press container having a substantially cylindrical section followed by a substantially funnel-shaped section.

Describing now the drawings, according to the exemplary embodiment of apparatus shown in FIG. 1, the press container 1 will be seen to comprise a substantially cylindrical shell or jacket 2 followed by a jacket section 3 of substantially funnel-shaped configuration and merging with the cylindrical shell or jacket section 2. The substantially cylindrical shell or jacket section 2 is closed at its end by a domed or arched end wall 4, whereas the substantially funnel-shaped shell or jacket section 3 terminates at an outlet or discharge 6 which can be closed by means of a suitable cover or cover member 5. A hollow journal or trunnion 50 mounted at the end wall 4 enables mounting the press container 1 in a bearing or pillow block 7. Apart from the foregoing structure the press container 1 also is equipped at the other end of the cylindrical shell or jacket section 2 with a bearing ring 8 which rests upon the rolls or rollers 9, of which only one is visible in the showing of FIG. 1 to simplify the illustration. As indicated by the schematically shown drive 10, the roll 9 is motor driven in order to place the press container 1 into rotation about its lengthwise or substantially horizontally extending axis.

Within the press container 1 there is located a substantially hood-shaped press or squeezing diaphragm 11, the marginal edge of which is sealingly anchored in appropriate fashion at the region of an axial plane of the container 1 at the cylindrical and funnel-shaped jacket sections 2 and 3 respectively, as well as at the end wall thereof. This anchoring structure which extends completely around the press container 1 has been generally indicated by reference character 12. By virtue of this arrangement the press container 1 is subdivided by the diaphragm or membrane 11 into a press or squeezing compartment 13 and a pressure compartment 14. The volume of the press or squeezing compartment 13 and the pressure compartment 14 changes as a function of the momentary configuration of the diaphragm 11. In order to deform the substantially hood-shaped squeezing diaphragm 11, the pressure compartment 14 can be connected in any suitable manner with a source of pressurized fluid medium. In the context of this disclosure the term "pressure" or "pressurized", where appropriate, is intended to signify both excess pressure as well as negative pressure, and it is thus contemplated to introduce the pressurized fluid medium into the pressure compartment 14 and to withdraw the same from such pressure compartment. To this end, the structure generally indicated by reference character 100 in FIG. 1, may operatively flow communicate via the hollow journal or trunnion 50 with the pressure compartment 14 for the purpose of introducing a pressurized fluid medium, such as compressed air, or may constitute means for applying a negative pressure to said pressure compartment 14. When the structure 100 supplies the pressurized fluid medium to the pressure compartment 14, then, the size of such pressure compartment is increased at the expense of the press or squeezing compartment 13, and in the other instance, when the structure 100 constitutes a means for supplying vacuum or negative pressure to the pressure compartment 14, then, the diaphragm 11 is more or less placed against the inner wall 1*a* of the press container 1. As above explained, the pressurized fluid medium can be introduced, for instance, at the region of the hollow journal 50 into the pressure compartment 14, and preferably measures are undertaken to ensure that the pressurized fluid medium can enter such pressure compartment while being distributed as uniformly as possible throughout.

The source 100 may be constituted by conventional hardware suitable for the intended purposes. Typically, for instance, it may contain a vacuum pump and a pressure pump for exerting the respective suction and pressure conditions. Equally, it can be conceivably constituted by a suitable compressor or blower, the inlet and outlet sides of which can be selectively operatively flow connected, as desired, with suitable respective infeed lines leading to the pressure compartment and the hereinafter to be discussed support elements or possibly product residue-ejection elements, respectively in order to establish the requisite "pressure" conditions. Such an arrangement has been disclosed in greater detail in the commonly assigned, copending United States application, Ser. No. 783,266, filed Mar. 31, 1977, now U.S. Pat. No. 4,106,404 and entitled "Apparatus For Separating Liquids And Solids From One Another, Especially For Extracting Juice From Agricultural Products", to which reference may be had and the disclosure of which is incorporated herein by reference. While the foregoing typifies possible constructions of the source 100 it in no way exhausts the possibilities which can be conceivably used and are available on the market, and since the invention is not concerned with any specific construction of such unit, further details thereof are not believed necessary for understanding the principles of the invention.

Figure 2:
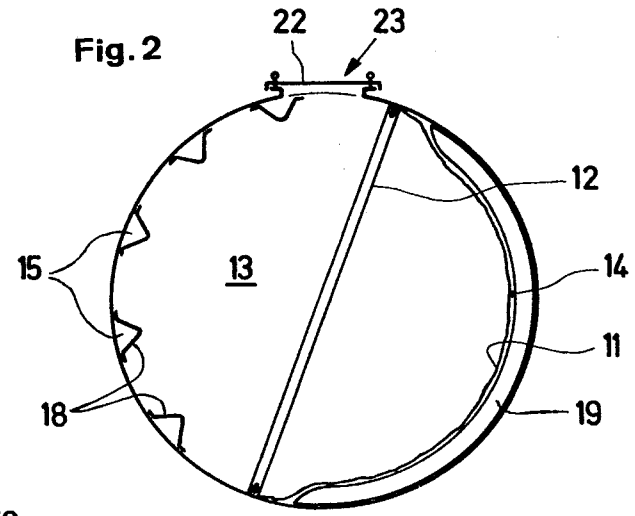
FIG. 2 is a cross-sectional view of the apparatus shown in FIG. 1 taken substantially along the line II—II thereof.

Continuing, from the showing of FIGS. 1 and 2 it will be seen that the juice outlet arrangement comprises a number of drainage channels 15 which, at the region of the end wall 4, terminate with an outlet pipe or stud 16. To simplify the showing in FIG. 1 there is only visible the one outlet stud or pipe 16. During rotation of the press container 1 these outlet studs or connections 16 come to lie over a collecting or catch trough 17 for the extracted juice, and therefore, such outlet connections 16 form the actual outflow means of the juice outlet arrangement. As best seen by referring to FIG. 2, the drainage channels 15 are formed by trough or chute elements 18 of substantially roof-shaped cross-sectional configuration, or equivalent structure, which extends along the surface lines or generatrices of the container sections 2 and 3. The trough elements 18 possess perforations which are not here further illustrated, preferably in the form of a multiplicity of elongate holes or openings which are transversely directed with respect to the direction of extent of the trough elements. Such construction of trough elements and the significance thereof, especially the specially provided and configured perforations, including possible variant constructions, constitute subject matter of the commonly assigned, copending United States application Ser. No. 752,668 of Hans Ulrich Hauser and Alfred Schmid, filed Dec. 20, 1976 and entitled "Apparatus for Separating Liquid and Solid Materials", to which reference may be readily had and the disclosure of which is incorporated herein by reference.

Further, it will be seen from the showing of FIGS. 1 and 2 that at the region of the squeezing diaphragm 11 there are provided outfeed or ejection elements, designated in their entirety by reference character 19. These outfeed or ejection elements 19, the purpose of which will be explained more fully hereinafter, extend along sections of a helical or screw line and protrude from the inner surface 11*a* of the squeezing diaphragm 11, as best seen by referring to FIG. 1. With the exemplary embodiment portrayed in FIGS. 1 and 2 the outfeed or ejection elements 19 are each provided with a support or supporting body 20 having a hollow sectional shape or profile and which are conveniently attached in any suitable manner, for instance by screws or with appropriate fastening expedients, to the shell or jacket sections 2 and 3 of the press container 1. The internal space or compartment 21 of each support body 20 can be impinged with a pressurized fluid medium, such as the infed compressed air. This allows the support bodies 20 to be constructed of a flexible material, for instance as hoses or hose-like members, since under the action of the infed pressurized fluid medium they have imparted thereto the requisite rigidity. The support bodies 20 are covered by the squeezing diaphragm or membrane 11 which, without having to resort to any further measures, can, when necessary, accomodate itself to the shape of the support bodies 20. This is particularly so when the squeezing diaphragm is formed of a flexible material, such as rubber for instance. Of course, the squeezing diaphragm 11 could also be appropriately profiled or shaped. In both cases, a negative pressure can be established in the pressure compartment 14, as previously explained for instance with the aid of the negative pressure source 100, in order to place the squeezing diaphragm 11 snugly into contact with the support bodies 20. What has been stated just heretofore also is valid even if the support bodies 20 are formed as solid sections. Apart from the ability to form the support bodies 20 of a flexible material as heretofore noted, it is conversely possible to of course form the same of a rigid material.

Figure 7:
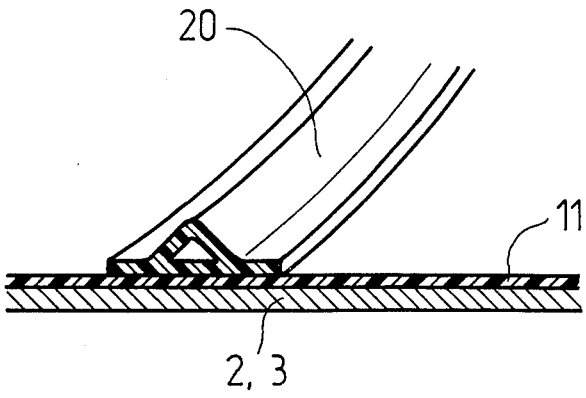
FIG. 7 is a fragmentary sectional view of a further modification of the invention.

In contrast to the illustrated embodiment it would be, however, possible to also attach elements (e.g. elements having a solid profile or section) and corresponding to the support bodies 20 directly on the squeezing diaphragm 11, instead of at the jacket or shell portions of the press cylinder 1, in order to thus directly form the outfeed or ejection elements, corresponding to the ejection or outfeed elements 19 previously discussed. Such an arrangement is shown in FIG. 7. With this modified construction, such outfeed or ejection elements 20 then have imparted thereto the requisite rigidity or stiffness for the outfeed of the residues, in any event at such time when the squeezing diaphragm 11 is snugly pressed against the wall 1*a* of the press container 1 under the action of the negative pressure produced in the pressure compartment 14. Independent of the foregoing it is also possible for the outfeed or ejection elements, possessing a hollow section or profile to be stiffened or reinforced with the aid of the internal pressure. By virtue of the thus possible hose-like soft construction the outfeed elements do not impair the requisite deformation of the squeezing diaphragm 11. The infeed of the pressurized fluid medium to such outfeed or ejection elements can be accomplished at the region of the anchoring structure 12 of the diaphragm and the hollow journal 50, for instance as previously explained in connection with the structure 100.

Now for the purpose of placing into operation the aforedisclosed apparatus, the press container 1 is initially rotated into the position illustrated essentially in FIG. 2, in other words into a position where the squeezing diaphragm or membrane 11 hangs downwards. Now if the pressure compartment 14 is connected with the negative pressure source, typified by the structure 100, then such squeezing diaphragm is placed into contact or at least spanned or tensioned in the direction of the jacket or shell sections 2 and 3 of the press container 1. By means of a filling or infeed opening 23, equipped with a suitable cover 22, it is now possible to introduce the mash i.e. the product to be processed, into the press container 1. Since part of the drainage channels 15 are located in the lower half of the press container 1, when the press container is dispositioned for filling in the manner shown in FIG. 2, the juice can flow-off already during the filling operation in the manner of a drip container or colander.

After completely filling the press container 1 the same is then brought into a position where the drain or outflow of the juice outlet arrangement i.e., the outlet or discharge studs or connections 16 thereof are located above the catch or collecting trough 17. Now by means of the structure 100 the compartment 14, instead of being exposed to the negative pressure, has applied an excess pressure thereto, and consequently the mash is subject to the action of the pressure cushion which builds-up in the pressure compartment 14. This pressure cushion, constituted by the pressurized fluid medium, surrounds the mash in the manner of a dome or curved cushion pocket, so that the mash cake is not simply pressed flat, as would be the case if there were merely used a piston, rather is extensively compressed while encased in such pressure cushion.

After completion of the pressing or squeezing operation the cover 5 is opened and the press container 1 placed into rotation by the drive arrangement 9, 10 in such a manner that the outfeed or ejection elements 19 convey the residues through the outlet 6 for deposit upon a suitable removal device, here shown in the form of a conveyor band or belt 24, but obviously could be another suitable product residue-conveying or removal device. By virtue of the tapered configuration of the press container 1 which exists at the region of the outlet or discharge 6 for the residues, removal of such residues is accomplished quickly and without any or any appreciable remains. In this connection the arrangement of the residue ejection elements 19 at the region of the diaphragm plays a particular role insofar as there can be prevented or is prevented the adherence of residues between or at the ejection elements.

Finally, it is here mentioned that at least parts of the juice outlet arrangement and/or the inlet of the pressure container may be oriented to extend in the axial or radial direction, for instance as apparent from the showing of FIGS. 1 and 2.

Figure 3:
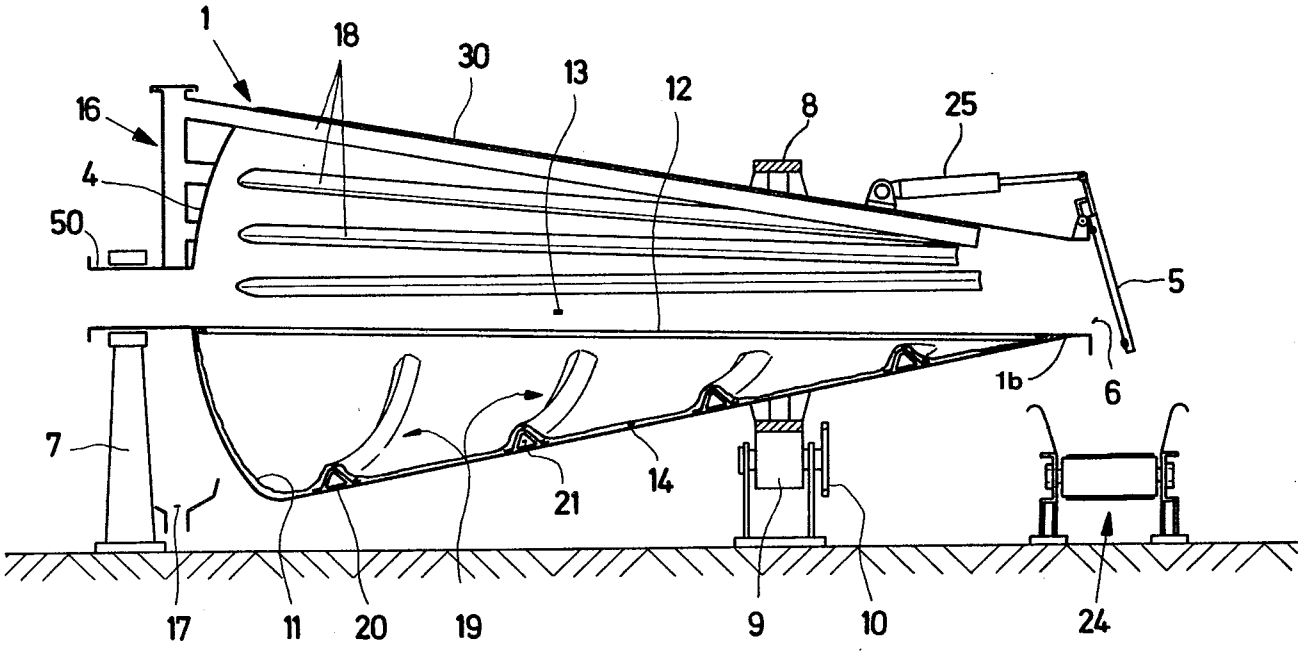
FIG. 3 is an axial sectional view of a modified form of apparatus utilizing a press container having a substantially funnel-shaped configuration over its entire extent or length.
Figure 4:
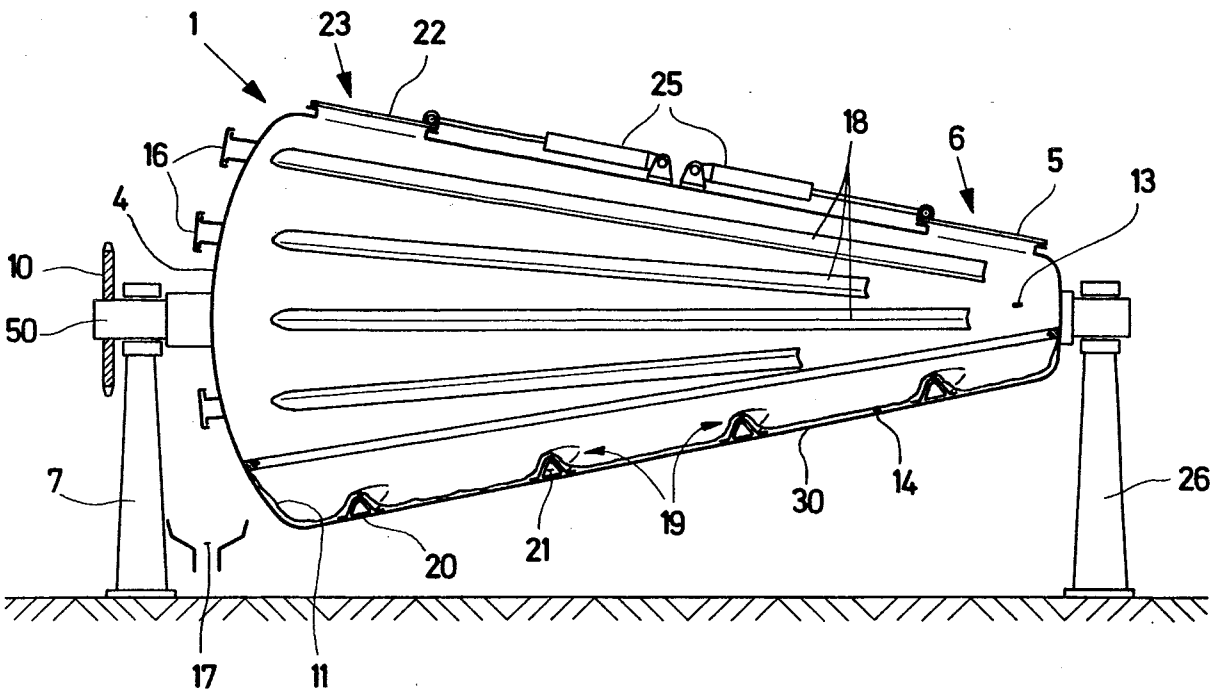
FIG. 4 is an axial sectional view, similar to the showing of FIG. 3, of a further embodiment of juice extraction apparatus.

The two further exemplary embodiments of apparatus for separating liquids and solids from one another as shown in FIGS. 3 and 4, respectively, differ from the embodiment according to FIG. 1 only insofar as the press container 1 is not here provided with any cylindrical jacket section, such as the section 2 of FIG. 1, rather has a conical jacket or shell 30 in each case. Insofar as the components of the embodiments of FIGS. 3 and 4 are analagous to those of the embodiment of FIGS. 1 and 2 there have been conveniently used the same reference characters as employed for the same or comparable components of the arrangement of FIG. 1. With the embodiment of FIG. 3 the mash is introduced through the hollow journal or trunnion 50. Incidently, the same manner of infeed can be utilized with regard to the arrangement of FIG. 1. Of course, also with this embodiment there could be provided, like with the juice extraction apparatus of FIG. 1, a product or mash infeed or filling opening 23. This is so for instance with the modified apparatus structure of FIG. 4 where such infeed opening 23 is clearly shown and also is equipped with a cover 22. Reverting again to the embodiment of FIG. 3 it will be seen that the press container 1 is provided at the region of its tapered end 1*b* with a radially dispositioned outlet or discharge 6 which is likewise closed by a cover member 5 similar to the arrangment of FIG. 1. This cover or cover member 5, as well as the cover 22 used in the equipment of FIG. 4, are operatively coupled with preferably pneumatic drive or actuation elements 25. This is also the case for the cover 5 of the arrangement of FIG. 4. With this modified equipment structure as shown in FIG. 4 the press container 1, apart from being mounted in the bearing or pillow block 7, is also mounted in a further bearing or pillow block 26. The conventional drive 10 e.g. gear is operatively connected with the bearing journal or hollow trunnion 50 mounted in the bearing block 7.

As concerns the operation of the embodiments of FIGS. 3 and 4 the same is analagous to the function disclosed in conjunction with the embodiment of FIG. 1, with the additional observation that owing to the conical-like configuration of the entire jacket or shell of the press container 1 the ejection output or capacity can be considerably increased.

Figure 5:
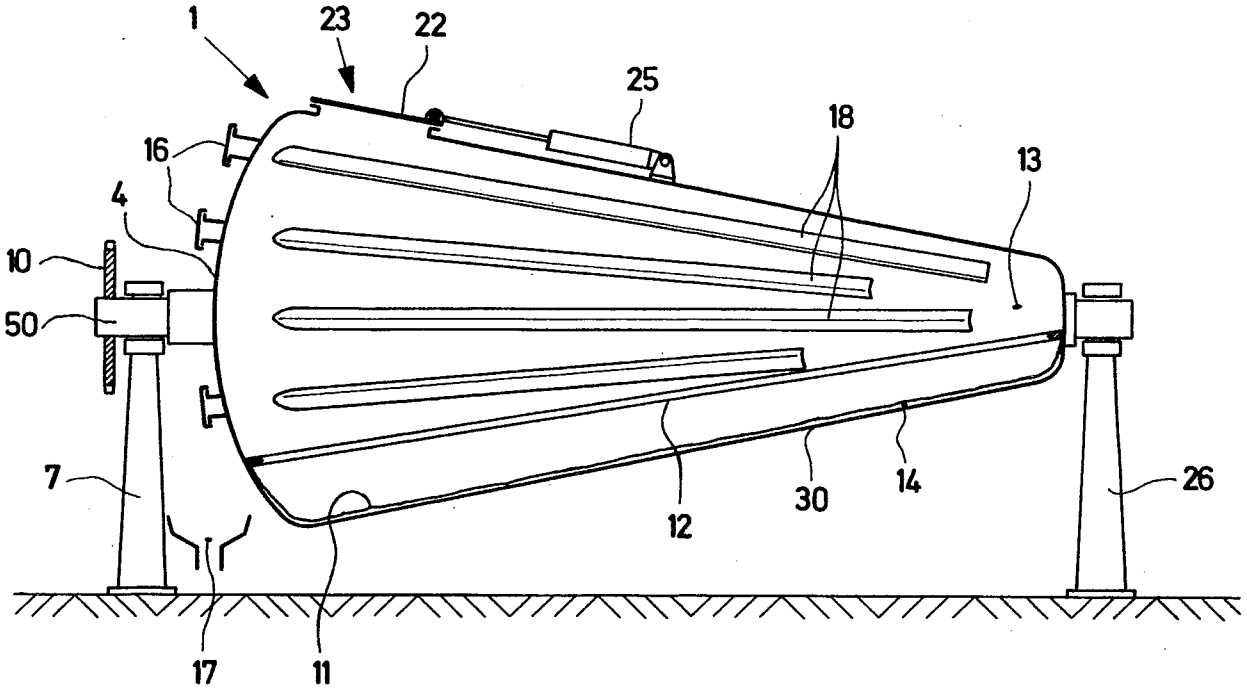
FIG. 5 is an axial sectional view, similar to the showing of FIGS. 3 and 4, of another embodiment of juice extraction apparatus.

The variant construction of equipment shown in FIG. 5 differs from that of FIGS. 3 and 4 essentially in that here there are not provided any outfeed or ejection elements. Consequently, the opening 23, which again can be closed by the cover 22 which is actuated by the drive or actuating element 25, here serves both for infeeding the mash as well as for the ejection or removal of the residues.

The embodiment of press container 1 described on the basis of the showing of FIG. 3, allows the mash to be introduced, for instance, through the hollow trunnion or journal 50 while the container is in a state of rotation, i.e. enables filling the container during such time as the residues are being ejected, so that the work cycle is not only shortened due to overlapping of the mash infeed and residue ejection or outfeed operations, but also such work cycle is abbreviated due to the fact that the removal of the juice is further intensified during the infeed phase due to the rotation of the press container 1 in that the drainage elements 15 are continuously freed of any filter cake which may have deposited thereon due to the moving mash.

Figure 6:
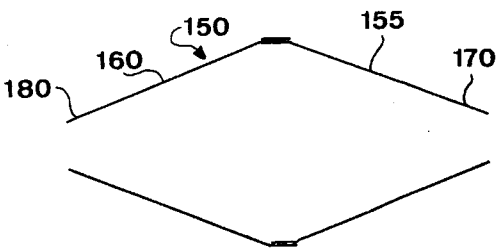
FIG. 6 is a schematic illustration of a further variant employing a press container substantially in the form of a double-cone which tapers towards each extreme end thereof.

Finally, with the schematically illustrated further exemplary embodiment of FIG. 6 the press container 150 schematically shown therein, will be seen to possess the shape of a double-cone composed of the two substantially conical-shaped jackets or shells 155 and 160. This double-cone press container 150 tapers or constricts towards both of its oppositely situated ends 170, 180. This modified embodiment allows for shorter squeezing or pressing times as well as permits symmetrical loading of the squeezing diaphragm 11, particularly along the anchoring structure 12.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for separating liquid and solid materials from one another, especially for the removal of juice from agricultural products, comprising:

a press container having a lengthwise extending axis;

means for mounting said press container to rotate about said lengthwise extending axis;

means for rotating said press container;

said press container having a product residue outlet and a form which tapers in the direction of said product residue outlet;

a substantially hood-shaped squeezing diaphragm subdividing the press container into a pressure compartment and a squeezing compartment;

means defining a liquid outlet arrangement provided for said squeezing compartment; and ejection means arranged in the squeezing compartment for transporting the product residue toward the product residue outlet in the manner of a worm screw.

2. The apparatus as defined in claim 1, wherein:

said press container includes a substantially cylindrical section followed by a therewith merging substantially funnel-shaped section;

said substantially cylindrical section including said widened region and said substantially funnel-shaped section providing said tapered configuration of at least a portion of said press container.

3. The apparatus as defined in claim 1, wherein:

said press container is constructed to possess a substantially funnel-shaped configuration over predominantly its entire length.

4. The apparatus as defined in claim 1, wherein:

at least portions of said liquid outlet arrangement are oriented in substantially the axial direction of said press container.

5. The apparatus as defined in claim 1, wherein:

at least portions of said liquid outlet arrangement are oriented in substantially the radial direction of said press container.

6. The apparatus as defined in claim 1, further including:

inlet means for the product for the infeed of such product into the squeezing compartment of said press container.

7. The apparatus as defined in claim 6, wherein:

at least part of said inlet means is oriented in the axial direction of said press container.

8. The apparatus as defined in claim 6, wherein:

at least part of said inlet means is oriented in the radial direction of said press container.

9. The apparatus as defined in claim 1, wherein:

said press container possesses opposed ends and is configured to taper in the direction of both of said opposed ends.

10. The apparatus as defined in claim 1, further including:

means for supplying a pressurized fluid medium to said pressure compartment.

11. The apparatus as defined in claim 1, further including:

means for subjecting the pressure compartment to a negative pressure.

12. An apparatus for separating liquid and solid materials from one another, especially for the removal of juice from agricultural products, in particular from fruit, comprising, in combination:

a press container having a lengthwise extending axis;

means for mounting said press container to rotate about said lengthwise extending axis;

means for rotating said press container;

said press container possessing a tapered configuration at least at a portion thereof and having a widened region;

a substantially hood-shaped squeezing diaphragm subdividing the press container into a pressure compartment and a squeezing compartment;

means defining a liquid outlet arrangement provided for said squeezing compartment;

said liquid outlet arrangement being arranged at the widened region of said press container; and ejection elements for the product residues provided for the squeezing compartment;

said ejection elements conveying the product residues in the axial direction of the press container and extending along sections of a worm screw.

13. The apparatus as defined in claim 12, wherein:

said ejection elements are arranged to coact with the squeezing diaphragm.

14. The apparatus as defined in claim 13, wherein:

said ejection elements are mounted on said squeezing diaphragm.

15. The apparatus as defined in claim 14, wherein:

said ejection elements are formed of a flexible material.

16. The apparatus as defined in claim 15, wherein:

said ejection elements are formed as hollow body members.

17. The apparatus as defined in claim 16, wherein:

said hollow body-ejection elements possess a hose-like construction; and means for providing a supply of compressed air to said hose-like ejection elements.

18. The apparatus as defined in claim 13, wherein:

said press container possesses an inner wall; and support bodies secured to said inner wall of said press container provided for said ejection elements.

19. The apparatus as defined in claim 18, wherein:

said support bodies are formed of a flexible material.

20. The apparatus as defined in claim 19, wherein:

said support bodies each are formed as a hollow body member.

21. The apparatus as defined in claim 20, wherein:

each of said support bodies possesses a hose-like construction; and means for connecting said hose-like constructed support bodies with a source of compressed air.

22. An apparatus for separating liquid and solid materials from one another, especially for the removal of juice from agricultural products, in particular from fruit, comprising, in combination:

a press container having a lengthwise extending axis;

means mounting said press container to rotate about said lengthwise extending axis;

means rotating said press container;

said press container possessing a tapered configuration at least at a portion thereof and having a product residue outlet;

a product squeezing member subdividing the press container into a pressure compartment and a squeezing compartment;

means defining a liquid outlet arrangement provided for said squeezing compartment; and ejection means arranged in the squeezing compartment for transporting the product residue toward the product residue outlet in the manner of a worm screw.

* * * * *

UNITED STATES PATENT AND TRADEMARK OFFICE

CERTIFICATE OF CORRECTION

PATENT NO. : 4,151,795

DATED : May 1, 1979

INVENTOR(S) : Hans U. Hauser

It is certified that error appears in the above-identified patent and that said Letters Patent are hereby corrected as shown below:

On the title page, item [75], "Hans U. Huaser" should read -- Hans U. Hauser--

On the title page, item [73], "Neiderweningen" should read --Niederweningen--

Signed and Sealed this

*Eighteenth* Day of *September 1979*

[SEAL]

*Attest:*

*Attesting Officer*

LUTRELLE F. PARKER

*Acting Commissioner of Patents and Trademarks*